US007461933B2

(12) United States Patent
Deily et al.

(10) Patent No.: US 7,461,933 B2
(45) Date of Patent: Dec. 9, 2008

(54) SHEET HEATER ASSEMBLY HAVING AIR BEARING PLATELETS

(75) Inventors: Michael F. Deily, Butte, MT (US); Danielle R. Hall, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 420 days.

(21) Appl. No.: 11/295,826

(22) Filed: Dec. 7, 2005

(65) Prior Publication Data

US 2007/0126834 A1 Jun. 7, 2007

(51) Int. Cl.
*B41J 2/01* (2006.01)

(52) U.S. Cl. ..... 347/102; 347/101; 347/262; 355/27; 355/73; 360/128; 360/245.1; 399/156; 399/380

(58) Field of Classification Search ..... None
See application file for complete search history.

(56) References Cited

U.S. PATENT DOCUMENTS

| | | | | | |
|---|---|---|---|---|---|
| 4,052,732 | A | | 10/1977 | Meadows | |
| 4,329,315 | A | * | 5/1982 | Brower et al. | 264/555 |
| 4,384,783 | A | * | 5/1983 | Sakata et al. | 399/156 |
| 5,020,244 | A | * | 6/1991 | Smith | 34/633 |
| 5,067,762 | A | * | 11/1991 | Akashi | 294/64.3 |
| 5,671,005 | A | * | 9/1997 | McNay et al. | 347/262 |
| 5,691,756 | A | | 11/1997 | Rise et al. | |
| 5,774,204 | A | * | 6/1998 | Suzuki et al. | 355/27 |
| 5,798,825 | A | * | 8/1998 | Blanding et al. | 355/73 |
| 5,831,655 | A | * | 11/1998 | Asawa et al. | 347/102 |
| 5,856,650 | A | | 1/1999 | Rise et al. | |
| 5,864,352 | A | * | 1/1999 | Aoki et al. | 347/102 |
| 6,048,059 | A | | 4/2000 | Wafler | |
| 6,161,930 | A | | 12/2000 | Asano | |
| 6,439,712 | B1 | * | 8/2002 | Mizutani et al. | 347/102 |
| 6,990,311 | B2 | * | 1/2006 | Pyle et al. | 399/380 |
| 2007/0230050 | A1 | * | 10/2007 | Ruiz | 360/128 |
| 2008/0151430 | A1 | * | 6/2008 | Zhu et al. | 360/245.1 |

FOREIGN PATENT DOCUMENTS

| | | |
|---|---|---|
| DE | 198 01 630 A1 | 8/1998 |
| EP | 0 568 174 A1 | 11/1993 |
| JP | 07 319303 | 12/1995 |

* cited by examiner

*Primary Examiner*—Luu Matthew
*Assistant Examiner*—John P Zimmermann
(74) *Attorney, Agent, or Firm*—Tallam I. Nguti

(57) ABSTRACT

An air bearing sheet heater assembly is provided for heating a sheet in an ink imaging printer. It includes a heater plate that has a heating element and defines a first side of a sheet path through the heater assembly. It also includes at least one movable platelet that defines a second side of the sheet path, as well as, an air bearing assembly mounted to the at least one platelet. The air bearing assembly controllably creates an air bearing between the second side and the first side of the sheet path for moving and pneumatically spacing the front surface of the at least one movable platelet from the front side of the heater plate, thereby reducing stiction forces and friction along the sheet path through the air bearing sheet heater assembly.

20 Claims, 6 Drawing Sheets

SHEET HEATER ASSEMBLY HAVING AIR BEARING PLATELETS

This disclosure relates to ink image printing machines or printers and, more particularly, to apparatus for preheating printing sheets, such as paper and transparency film, prior to ink printing on such sheets. Specifically, this disclosure relates to such a sheet heater assembly having air-bearing platelets for reducing stiction forces and friction between fed sheets and sheet-path defining plates of the heater.

Some conventional printer systems require printing sheets to be uniformly preheated prior to printing to provide an aesthetic and durable output. Typical heaters employ radiant or convective heat sources adjacent to the paper path and "upstream" of the print head. These existing heaters have several disadvantages. A lack of uniformity in heating can cause non-uniform printer output, and sheet warping or cockle. Examples of conventional sheet heaters or preheaters are disclosed in the following references:

U.S. Pat. No. 5,691,756 issued on Nov. 25, 1997 entitled "Printer media preheater and method" discloses a media preheater positioned in the media path of a printer and having a fixed heater and a movable plate array biased toward the heater such that printing media passing between the heater and the plate array is compressed therebetween and heated. The preheater may be positioned upstream of a print head and downstream of a media advancing mechanism in the media path. More than one plate may be provided in the plate array to accommodate non-planarity of the heater or the printing medium. The plate array may be a thermally massive element that contacts the heater when no media is present, thereby permitting the medium to be heated from both sides.

U.S. Pat. No. 5,856,650 issued on Jan. 5, 1999 entitled "Method of cleaning a printer media preheater" discloses a method of cleaning a media preheater that is positioned in the media path of a printer. The media preheater [a plate on plate type] has a fixed heater and a movable plate array biased toward the heater such that printer media passing between the plate array and the heater is compressed therebetween and heated. The preheater may be positioned upstream of a print head and downstream of a media advancing mechanism in the media path. More than one plate may be provided in the plate array to accommodate non-planarity of the heater or the printing media. The method elevates the temperature of the contact surface of the preheater to a cleaning temperature that is greater than the operating temperature and then passes a chase sheet over the surface to remove contamination from the preheater surface.

U.S. Pat. No. 6,048,059 issued on Apr. 11, 2000 entitled "Variable power preheater for an ink printer" discloses a preheater placed between a supply tray station and a print zone of an ink printer. Power to the preheater is varied so that the preheater is heated to a fist relatively high temperature during the time that the recording medium is advanced from the supply station to the print zone. When the recording medium enters the print zone, the medium is moved at a slower indexing speed, and the power to the preheater is reduced to a second level. The result is a more uniform application of preheat to the recording medium.

Conventional Plate On Plate (POP) preheaters as disclosed above, provide good heat transfer to the sheet being fed through the preheater. Unfortunately however, such conventional preheaters create significant drag on the sheet or paper undesirably resulting in feed reliability problems such as jams and sheet edge stubbing. Smudging of duplex or two-sided images and poor sheet registration are also other undesirable results.

Furthermore, in order to assure the good heat transfer mentioned above, the POP preheater and platelets must be extremely flat, and thus require tight tolerances and are therefore costly to make. A negative consequence of this flatness however, is the generation of a significant undesirable stiction (that is, the force required to cause one platelet in contact with the heater plate to begin moving away from the heater plate) between the platelets and the preheater. Such stiction is thought to be a combination of vanderwaals forces and vacuum created between the very flat surfaces, as the platelets are being open. It is believed that sheet jamming and stubbing occurs at the entrance to the preheater because the sheet upon entering the preheater must first overcome this stiction force.

Solid ink images will be transferred to the heater plate side of the paper or sheet. The platelets themselves become heated from contact with the heater plate and thus themselves also transfer heat to the sheet. The weight of the platelets also act to force the sheet being fed through the pre-heater down against the heater plate, thus dramatically increasing the heat transfer rate from the heater plate to the sheet. As such, during duplex or two-sided printing when e sheet with an ink image on a first side thereof is re-fed through the preheater, the already inked-side of the sheet, (now a back side) contacts and rubs against the platelets as it is fed through the preheater. During such rubbing, the coefficient of friction between the inked page of the sheet and the platelets (which is significantly higher than if the page was blank), undesirably causes the ink image on the page to smudge.

In accordance with the present disclosure, there has been provided an air bearing sheet heater assembly for heating a sheet in an ink imaging printer that includes (a) a heater plate including a heating element, and having a front side defining a first side of a sheet path through the heater assembly; (b) at least one movable platelet having a back surface 122, and an opposite front surface 124 facing the heater plate and defining a second side of the sheet path; and (c) an air bearing assembly mounted to the at least one platelet for creating an air bearing between the second side and the first side of the sheet path by pneumatically spacing the front surface 124 of the at least one movable platelet from the front side of the heater plate, thereby reducing stiction forces and friction along the sheet path through the air bearing sheet heater assembly.

The features and advantages of the disclosure will become apparent upon consideration of the following detailed disclosure, especially when it is taken in conjunction with the accompanying drawings in which.

Figure 1:
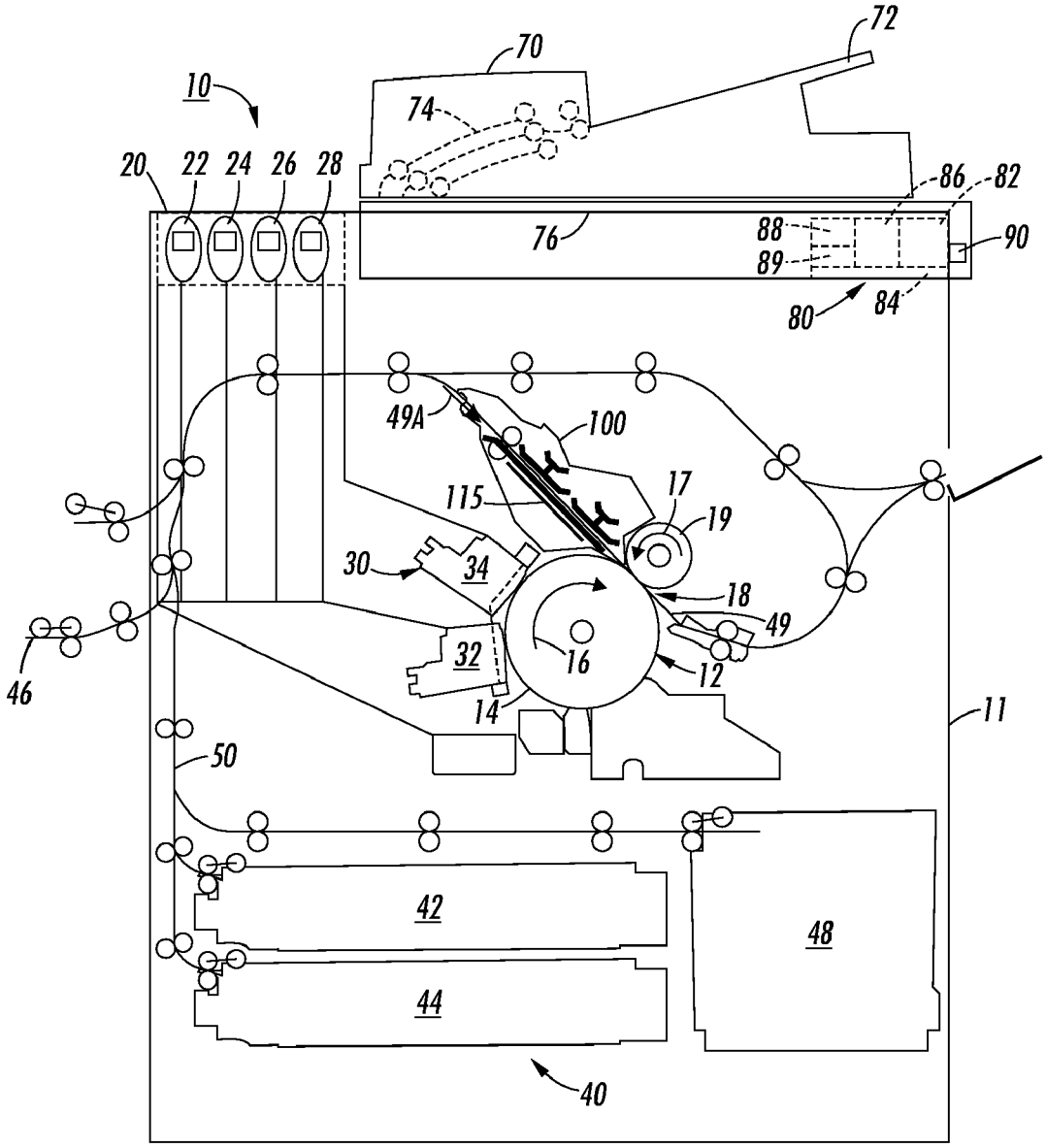
FIG. 1 is a vertical schematic of an exemplary phase change ink image producing machine or printer including the air bearing sheet heater assembly of the present disclosure.

Referring now to FIG. 1, there is illustrated an image producing machine, such as a high-speed phase change ink image producing machine or printer 10 of the present disclosure. As illustrated, the machine 10 includes a frame 11 to which are mounted directly or indirectly all its operating subsystems and components, as will be described below. To start, the high-speed phase change ink image producing machine or printer 10 includes an imaging member 12 that is shown in the form of a drum, but can equally be in the form of a supported endless belt. The imaging member 12 has an imaging surface 14 that is movable in the direction 16, and on which phase change ink images are formed. A heated transfix roller 19 rotatable in the direction 17 is loaded against the surface 14 of drum 12 to form a transfix nip 18, within which ink images formed on the surface 14 are transfixed onto a heated copy sheet 49.

The high-speed phase change ink image producing machine or printer 10 also includes a phase change ink delivery subsystem 20 that has at least one source 22 of one color phase change ink in solid form. Since the phase change ink image producing machine or printer 10 is a multicolor image producing machine, the ink delivery system 20 includes four (4) sources 22, 24, 26, 28, representing four (4) different colors CYMK (cyan, yellow, magenta, black) of phase change inks. The phase change ink delivery system also includes a melting and control apparatus (not shown) for melting or phase changing the solid form of the phase change ink into a liquid form. The phase change ink delivery system is suitable for then supplying the liquid form to a printhead system 30 including at least one printhead assembly 32. Since the phase change ink image producing machine or printer 10 is a high-speed, or high throughput, multicolor image producing machine, the printhead system 30 includes multicolor ink printhead assemblies and a plural number (e.g. four (4)) two 32, 34, of which are shown as of separate printhead assemblies. In order to achieve and maintain relatively high quality image productions by the printhead assembly.

As further shown, the phase change ink image producing machine or printer 10 includes a substrate supply and handling system 40. The substrate supply and handling system 40 for example may include sheet or substrate supply sources 42, 44, 46, 48, of which supply source 48 for example is a high capacity paper supply or feeder for storing and supplying image receiving substrates in the form of cut sheets 49 for example. The substrate supply and handling system 40 also includes a substrate or sheet heater or pre-heater assembly 100 in accordance with the present disclosure, (to be described in detail below). The phase change ink image producing machine or printer 10 as shown may also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 for example is a self-contained, dedicated mini-computer having a central processor unit (CPU) 82, electronic storage 84, and a display or user interface (UI) 86. The ESS or controller 80 for example includes sensor input and control means 88 as well as a pixel placement and control means 89. In addition the CPU 82 reads, captures, prepares and manages the image data flow between image input sources such as the scanning system 76, or an online or a work station connection 90, and the printhead assemblies 32, 34. As such, the ESS or controller 80 is the main multi-tasking processor for operating and controlling all of the other machine subsystems and functions, including the air bearing sheet heater or pre-heater assembly 100 of the present disclosure.

In operation, image data for an image to be produced is sent to the controller 80 from either the scanning system 76 or via the online or work station connection 90 for processing and output to the printhead assemblies 32, 34. Additionally, the controller determines and/or accepts related subsystem and component controls, for example from operator inputs via the user interface 86, and accordingly executes such controls. As a result, appropriate color solid forms of phase change ink are melted and delivered to the printhead assemblies. Additionally, pixel placement control is exercised relative to the imaging surface 14 thus forming desired images per such image data, and receiving substrates are supplied by anyone of the sources 42, 44, 46, 48 and handled by means 50 in timed registration with image formation on the surface 14. Finally, the image is transferred from the surface 14 and fixedly fused to the copy sheet within the transfix nip 18.

Figure 2A:
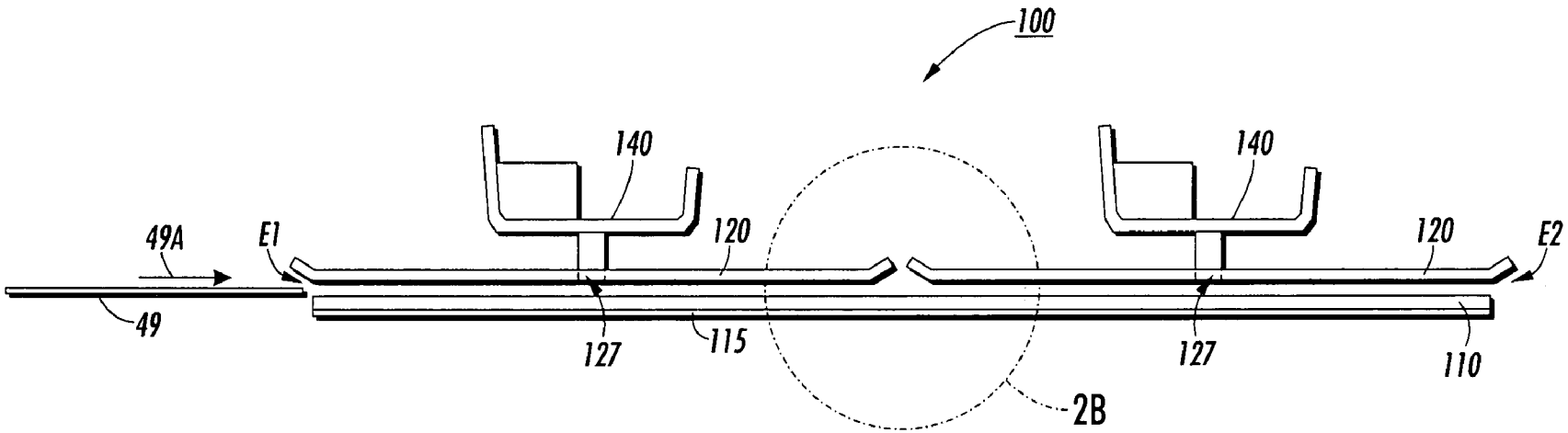
FIG. 2A is a schematic of the air bearing sheet heater assembly of FIG. 1.
Figure 2B:
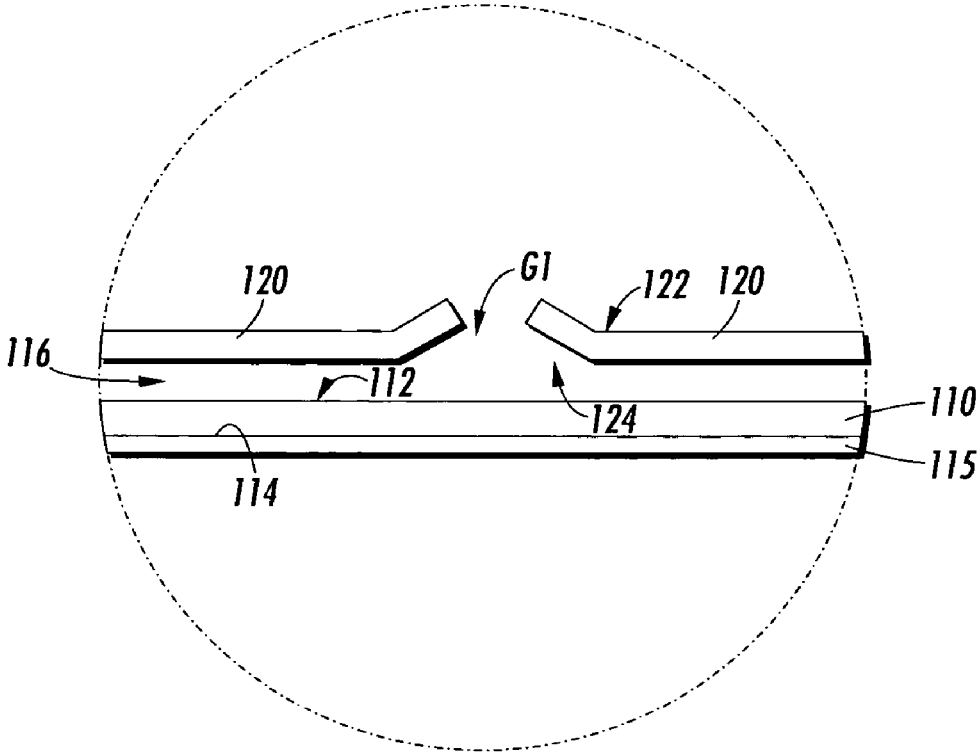
FIG. 2B is an enlarged schematic of the portion of the air bearing sheet heater assembly of FIG. 2A as encircled.
Figure 3:
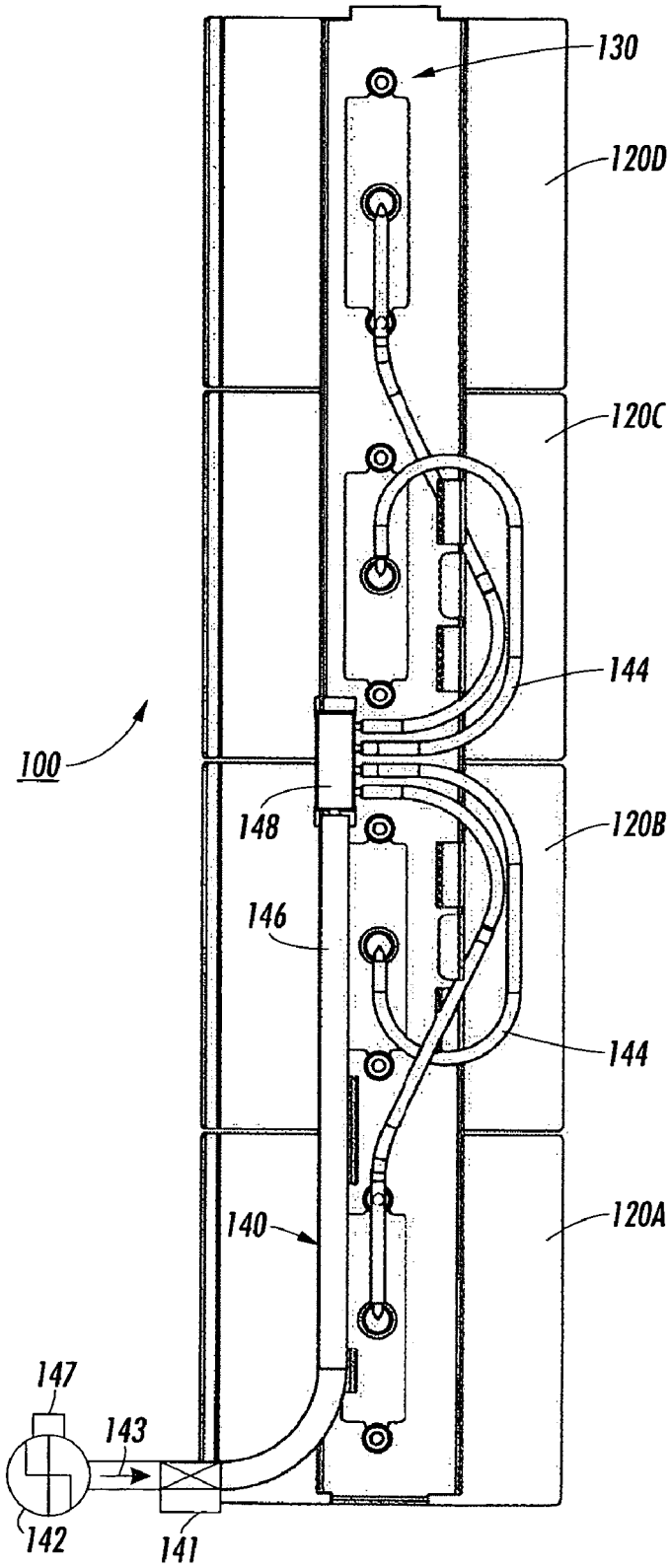
FIG. 3 is a top view of one array of platelets in the air bearing sheet heater assembly of FIG. 2.
Figure 4:
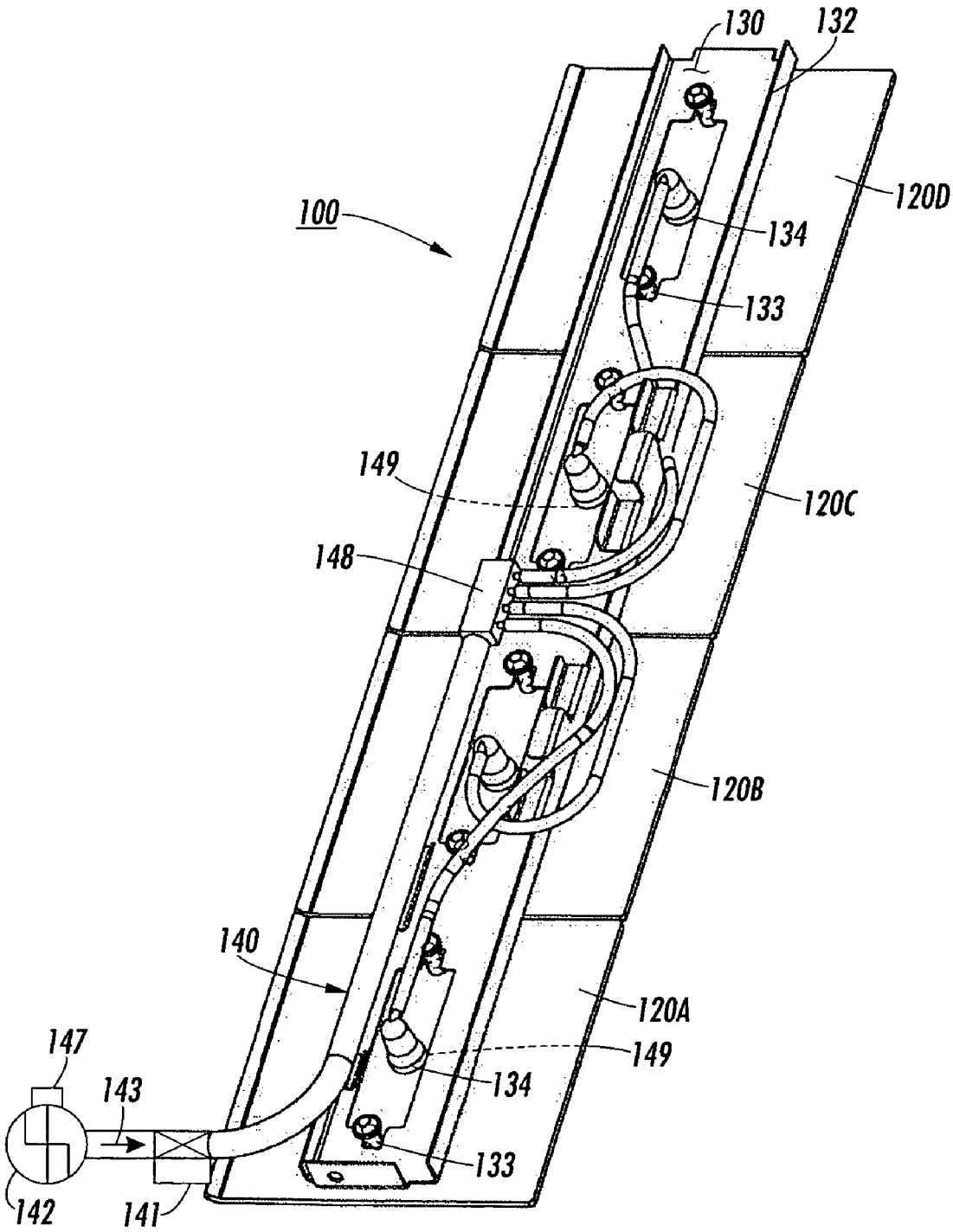
FIG. 4 is a perspective view of the array of platelets in the air bearing sheet heater assembly of FIG. 3.
Figure 5:
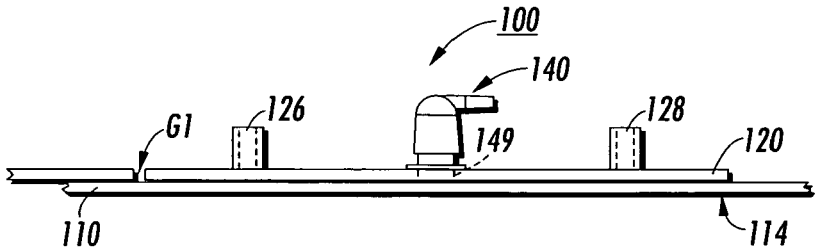
FIG. 5 is a vertical side view a portion of the air bearing heater assembly showing a platelet resting gravitationally on the heater plate.

Referring now to FIGS. 1-6, the air bearing sheet heater assembly 100 is described in detail, and is suitable for preheating a sheet in an ink imaging machine or printer prior to forming an image on the sheet. As illustrated, the air bearing sheet heater assembly 100 includes a heater plate 110 having a front side 112 and including a heating element 115 mounted to a back side 114 of the heater plate opposite the front side 112 thereof. As mounted within the heater assembly 100, the front side 112 of the heater plate defines a first side of a sheet path 116 through the heater assembly. The air bearing sheet heater assembly 100 also includes at least one movable platelet 120A, 120B, 120C, 120D having a back surface 122, and an opposite front surface 124 facing the heater plate 110 and defining a second side of the sheet path 116. The at least one movable platelet 120A, 120B, 120C, 120D is mounted for floating relative to the sheet path 116 portion and to the front side 112 of the heater plate 110. In one embodiment, the at least one movable platelet comprises a plural number, for example two sets of arrays of four platelets each, one set as shown in FIGS. 3 and 4. The platelets are mounted so that there is a gap G1 of about 1-2 mm between adjacent platelets for allowing them to move freely and independently. The sets or arrays of four platelets 120 as shown in FIG. 2A are mounted so that one is upstream and the other is downstream relative to each other, given a direction 49A of sheet movement through the heater assembly 100.

As illustrated in FIGS. 2-4, the air bearing sheet heater assembly 100 includes low friction constraint assemblies 130 mounted to the frame 11 of the machine, and above the at least one movable platelet (in other words above each platelet 120A, 120B, 120C, 120D) for further allowing and constraining the low friction and independent movement of each platelet in x, y and z directions. Each low friction constraint assembly 130 includes a fixed plate 132 mounted spaced several millimeters from the back surface 122 of each platelet, and through which appropriate holes 133, 134 are cut for receiving and allowing low friction movement of flexible air hoses or tubes 144 of the air bearing assembly 140 of the present disclosure, as well as of a pair of guiding studs 126, 128 on each platelet. As such, the low friction constraint assembly is able to allow up and down movement of each platelet 120A, 120B, 120C, 120D relative to the fixed plate 132.

Figure 6:
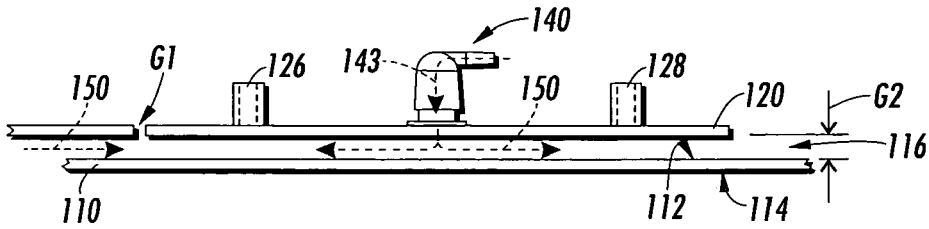
FIG. 6 is a vertical side view of FIG. 5 showing the air bearing in operation with a thin film of air forming a gap between the heater plate and the platelet in accordance with the present disclosure.

In accordance with the present disclosure, the air bearing sheet heater assembly 100 further includes an air bearing assembly 140 that is mounted to the at least one platelet 120A, 120B, 120C, 120D for creating an air bearing or thin film 150 of pressurized air between the second side and the first side of the sheet path 116 as illustrated in FIG. 6. The thin film 150 of pressurized air acts as an air bearing by pneumatically spacing the front surface 124 of the at least one movable platelet 120A, 120B, 120C, 120D from the front side 112 of the heater plate, thereby reducing stiction forces and friction along the sheet path 116 through the air bearing sheet heater assembly 100.

As illustrated, the air bearing assembly 140 includes (a) a source 142 of pressurized air for producing and supplying pressurized air 143; (b) an air conduit assembly connecting the source 142 of pressurized air to the sheet path 116 portion through the air bearing sheet heater assembly 100; (c) a hole or port 127 formed through the at least one movable platelet 120A, 120B, 120C, 120D from the back surface 122 to, and through, the front surface 124 into the sheet path 116 portion; and (d) air flow control or regulating means 147, such as a voltage means or an air pressure regulator, for regulating at least a pressure of air 143 flowing through the conduit assembly into the sheet path 116 portion. In an embodiment thereof, the source 142 of pressurized air comprises a positive displacement pump.

Referring in particular to FIG. 3, the air bearing sheet heater assembly 100 may also include an air-heating element 141 associated with the air bearing assembly 140 for heating the pressurized air 143 that will form the air bearing 150. As shown, pressurized air 143 from the source 142, regulated by means 147, and optionally heated by element 141, is pumped through the main air line 146 into a manifold 148 for distribution into the various flexible hoses or tubes 144 of an array of platelets 120. Thus the manifold 148 connects the source 142 of pressurized air to the plural number of the at least one movable platelet 120A, 120B, 120C, 120D.

Thus the air conduit assembly for each platelet 120A, 120B, 120C, 120D includes a flexible air tube 144 and a nozzle 149 sealingly connecting the flexible tube 144 through the air port or hole 127 in the at least one movable platelet 120A, 120B, 120C, 120D. Pressurized air 143 supplied into the sheet path 116 portion is vented to and through mainly an entrance opening E1 and an exit opening E2 of the sheet portion. Some such air is also vented through the gaps G1 between adjacent platelets.

Thus in accordance with the present disclosure, the air bearing sheet heater or pre-heater assembly 100 is capable creating an air bearing 150 between the heater plate 110, or sheet (when being fed), and the movable platelets 120. The pressurized air 143 is pumped into the sheet path 116 through the air port 127 near the center of each movable platelet 120A, 120B, 120C, 120D to create an air pressure of about 2.8 in-H2O (0.1 PSIG) between the heater plate 110 and such platelet. This is because the front surface 124 of each such platelet 120A, 120B, 120C, 120D is relatively flat, is impervious to air, and covers a significant distance in every direction from the air port 127 to its edges where the pressurized air is able to escape. The weight of each platelet 120A, 120B, 120C, 120D as mounted above the heater plate 110 is determined such that the about 2.8 in-H2O (0.1 PSIG) air pressure is sufficient to counter and overcome the weight of the platelet with fairly low volume flow rates of air.

As pointed out above, the pressurized air source for example is a positive displacement pump, and includes conventional means 147 for regulating the airflow and air pressure and comprise voltage regulators and valves. An air heater 141 may be included for separately warming the pressurized air being used, however, it has been found that the heat capacity of the air is relatively small in comparison to the total heat transfer rate of the heater, so that the air bearing 150 does not significantly impact thermal performance of the heater.

As shown, the platelets or platelet arrays are mounted above the heater plate 110, and each platelet 120A, 120B, 120C, 120D ordinarily (when the air bearing is not in operation) rests gravitationally on the portion of the heater plate below it. However, as illustrated in FIG. 6, in operation, with the timed arrival of a sheet under the control of the controller 80, the positive displacement pump 142 and pressurized air regulators 147 are activated to pump air 143 through the main air line 146 and manifold 148 into each flexible tube 144, and through the nozzle 149 within the air port 127 of each platelet into the sheet path 116 under each such platelet 120A, 120B, 120C, 120D. The flatness and imperviousness of the heater plate front side 112 and those of the front surface 124 of each platelet 120A, 120B, 120C, 120D cooperate to form an air bearing or a thin film 150 of pressurized air 143, and hence a pneumatic gap G2, between the platelet 120A, 120B, 120C, 120D and heater plate 110.

When a sheet 49 is being fed through the sheet path 116 over the front side 112 of the heater plate, the thin film 150 of pressurized air 143 instead forms between the back or upper side of the sheet 49 and the front surface 124 of each platelet, and there acts as a fluid or air bearing 150 between the platelet and the sheet. It has been found that the air bearing 150 results in a much lower coefficient of friction between the sheet and the platelet. The reduced friction was found to be even more significant between the platelets and previously inked upper sides of sheets than blank sides of sheets. It was also found that the air gap and air bearing between the platelets and the heater plate completely eliminated stiction between the two, greatly improving sheet feed reliability.

Platelets are made of Aluminum, for example anodized or Nickel plated aluminum. Each sheet enters the preheater at ambient temperature of about 30° C., and exits at a temperature of about 60° C. It has also been found that the temperature of sheets exiting the heater assembly 100 at a given set point was slightly lower with unheated air turned on (as expected), than with such air off. However, the sheet temperature ranges (across and down the page), were equivalent with and without such air. It was further found that sheet stubbing and jam performance were also significantly improved by turning on the air bearing. For example, without the air bearing, the jam rate was 70% at 0.5 m/s, but with the air bearing, the jam rate was 0.0%.

As can be seen, there has been provided an air bearing sheet heater assembly for heating a sheet in an ink imaging printer that includes (a) a heater plate including a heating element, and having a front side defining a first side of a sheet path through the heater assembly; (b) at least one movable platelet having a back surface 122, and an opposite front surface 124 facing the heater plate and defining a second side of the sheet path; and (c) an air bearing assembly mounted to the at least one platelet for creating an air bearing between the second side and the first side of the sheet path by pneumatically spacing the front surface 124 of the at least one movable platelet from the front side of the heater plate, thereby reducing stiction forces and friction along the sheet path through The air bearing sheet heater assembly.

Accordingly, the spirit and broad scope of the appended claims is intended to embrace all such changes, modifications and variations that may occur to one of skill in the art upon a reading of the disclosure. All patent applications, patents and other publications cited herein are incorporated by reference in their pertinent part.

What is claimed is:

1. An air bearing sheet heater assembly for heating a sheet, the air bearing sheet heater assembly comprising:

(a) a heater plate having a front side and including a heating element, said front side of said heater plate defining a first side of a sheet path through said heater assembly;

(b) at least one movable platelet having a back surface, and an opposite front surface facing said heater plate and defining a second side of said sheet path; and (c) an air bearing assembly mounted to said at least one moveable platelet, said air bearing assembly including means creating an air bearing between said second side and said first side of said sheet path for moving and pneumatically spacing said front surface of said at least one movable platelet from said front side of said heater plate, thereby reducing stiction forces and friction along said sheet path through said sheet heater assembly.

2. The air bearing sheet heater assembly of claim 1, wherein said air bearing assembly includes:

(a) a source of pressurized air for producing and supplying pressurized air;

(b) an air conduit assembly connecting said source of pressurized air to said sheet path portion;

(c) a hole formed through said at least one movable platelet from said back surface to, and through, said front surface into said sheet path portion; and (d) air flow control means for regulating at least a pressure of air flowing through said conduit assembly into said sheet path portion.

3. The air bearing sheet heater assembly of claim 1, including an air-heating element associated with said air bearing assembly for heating pressurized air forming said air bearing.

4. The air bearing sheet heater assembly of claim 1, including a low friction constraint assembly mounted to said at least one platelet for allowing and constraining movement of said at least one platelet in x, y and z directions.

5. The air bearing sheet heater assembly of claim 2, including a manifold for connecting said source of pressurized air to a plural number of said at least one movable platelet.

6. The air bearing sheet heater assembly of claim 2, wherein said source of pressurized air comprises a positive displacement pump.

7. The air bearing sheet heater assembly of claim 2, wherein said air conduit assembly includes a flexible air tube and a nozzle sealingly connecting said flexible tube through said hole in said at least one movable platelet.

8. The air bearing sheet heater assembly of claim 2, wherein pressurized air supplied into said sheet path portion is vented to and through an entrance opening and an exit opening of said sheet portion.

9. The air bearing sheet heater assembly of claim 2, wherein said airflow control means include an air pressure regulator.

10. The air bearing sheet heater assembly of claim 4, wherein said low friction constraint assembly includes a fixed plate mounted spaced from said back side of said at least one platelet, stud holes formed through said fixed plate, and studs attached to said at least one platelet for moving freely within said stud holes.

11. A printer comprising:

(a) a printer frame (b) a marking unit mounted to said printer frame for forming ink images on sheets;

(c) a sheet supply assembly mounted to said printer frame including a sheet path and drive nips for contactably moving each sheet by its edges along said sheet path through said printer;

(d) a sheet preheater assembly mounted along a portion of said sheet path, upstream of said marking unit relative to sheet movement, for heating each sheet being moved along said sheet path, the sheet preheater assembly including:

(i) a heating device having a heating element, and a heater plate including a back side attached to said heating element and a front side defining a first side of said portion of said sheet path through the sheet preheater assembly;

(ii) at least one movable platelet mounted above said heater plate and including a back surface, and an opposite front surface defining a second side of a portion of said sheet path through the sheet preheater assembly; and (iii) an air bearing assembly mounted to said at least one moveable platelet, said air bearing assembly including means creating an air bearing between said second side and said first side of said sheet path for moving and pneumatically spacing said front surface of said at least one movable platelet from said front side of said heater plate, thereby reducing stiction forces and friction along said sheet path through said sheet heater assembly.

12. The printer of claim 11, wherein said at least one movable platelet is mounted for floating relative to said sheet path portion and said front surface of said heater plate.

13. The printer of claim 11, said sheet preheater assembly includes a plural number of said at least one movable platelet.

14. The printer of claim 11, wherein said air bearing assembly includes:

(a) a source of pressurized air for producing and supplying pressurized air;

(b) an air conduit assembly connecting said source of pressurized air to said portion of said sheet path;

(c) a hole formed through said at least one movable platelet from said back surface to, and through, said front surface into said portion of said sheet path; and (d) air flow control means for regulating at least a pressure of air flowing through said conduit assembly into said portion of said sheet path.

15. The printer of claim 11, including an air-heating element associated with said air bearing assembly for heating pressurized air forming said air bearing.

16. The printer of claim 14, including a manifold for connecting said source of pressurized air to a plural number of said at least one movable platelet.

17. The printer of claim 14, wherein said source of pressurized air comprises a positive displacement pump.

18. The printer of claim 14, wherein said air conduit assembly includes a flexible air tube and a nozzle sealingly connecting said flexible tube through said hole in said at least one movable platelet.

19. The printer of claim 14, wherein pressurized air supplied into said portion of said sheet path is vented in part to and through an entrance opening and an exit opening of said sheet portion.

20. The printer of claim 14, wherein said airflow control means include an air pressure regulator.

* * * * *